US009041284B2

(12) United States Patent
Naijo

(10) Patent No.: US 9,041,284 B2
(45) Date of Patent: May 26, 2015

(54) DISPLAY DEVICE UTILIZING A FLEXIBLE SUBSTRATE CONFIGURED TO BE FOLDED

(71) Applicant: SAMSUNG DISPLAY CO., LTD., Yongin, Gyeonggi-Do (KR)

(72) Inventor: Tsuyoshi Naijo, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/021,975

(22) Filed: Sep. 9, 2013

(65) Prior Publication Data

US 2014/0117844 A1 May 1, 2014

(30) Foreign Application Priority Data

Oct. 29, 2012 (KR) ..... 10-2012-0120716

(51) Int. Cl.
*H05B 33/04* (2006.01)

(52) U.S. Cl.
CPC ..... *H05B 33/04* (2013.01)

(58) Field of Classification Search
CPC ..... G06F 1/1652; G06F 1/1616; G06F 3/041; G06F 3/045; H05K 5/0226; H05K 5/0017; H05K 1/028
USPC ..... 313/498–511, 512
See application file for complete search history.

(56) References Cited

U.S. PATENT DOCUMENTS

| | | | | |
|---|---|---|---|---|
| 7,033,911 | B2 * | 4/2006 | Manepalli et al. | 438/455 |
| 2012/0154707 | A1 * | 6/2012 | Hsieh et al. | 349/60 |
| 2013/0194761 | A1 * | 8/2013 | Kim | 361/749 |
| 2014/0049449 | A1 * | 2/2014 | Park et al. | 345/1.3 |
| 2014/0097408 | A1 * | 4/2014 | Kim et al. | 257/40 |
| 2014/0145161 | A1 * | 5/2014 | Naijo | 257/40 |

FOREIGN PATENT DOCUMENTS

| | | |
|---|---|---|
| JP | 8-203669 | 8/1996 |
| JP | 2008-159309 A | 7/2008 |
| KR | 10-0637197 | 10/2006 |

OTHER PUBLICATIONS

Korean Patent Abstracts, Publication No. 1020060058463 A, dated May 30, 2006, for corresponding Korean Patent KR 10-0637197 listed above.

* cited by examiner

*Primary Examiner* — Tracie Y Green
(74) *Attorney, Agent, or Firm* — Christie, Parker & Hale, LLP

(57) ABSTRACT

A flexible display device including: a flexible substrate having a display area and a moisture absorption area at a surface; a display unit at the display area; a moisture absorption layer at the moisture absorption area; and a sealant along an edge of the display area and configured to seal the moisture absorption layer and the display unit. The flexible substrate is configured to be folded at least one time, and the display area and the moisture absorption area are opposite to each other.

11 Claims, 14 Drawing Sheets

DISPLAY DEVICE UTILIZING A FLEXIBLE SUBSTRATE CONFIGURED TO BE FOLDED

CROSS-REFERENCE TO RELATED APPLICATION

This application claims priority to and the benefit of Korean Patent Application No. 10-2012-0120716 filed in the Korean Intellectual Property Office on Oct. 29, 2012, the entire content of which is incorporated herein by reference.

BACKGROUND

1. Field

Embodiments of the present invention relate generally to a flexible display device. More particularly, embodiments of the present invention relate generally to a flexible display device including an organic light emitting diode (OLED).

2. Description of Related Art

An OLED display is a self-luminescent display for displaying an image with OLEDs that emit light. Because the OLED display generally does not require a separate light source, unlike a liquid crystal display (LCD), the OLED display may have a relatively reduced thickness and weight. Further, the OLED display may exhibit high-quality characteristics such as lower power consumption, high luminance, and a rapid reaction speed, and thus may be a next generation display device of a portable electronic device.

An OLED may be deteriorated by an internal factor such as deterioration of an organic emission layer by oxygen from indium tin oxide (ITO) that is used as an electrode material, deterioration by a reaction between interfaces of organic material layers constituting the organic emission layer, and/or deterioration by an external factor such as external moisture and oxygen or ultraviolet rays. Particularly, external oxygen and moisture may have a fatal influence on a life-span of the OLED.

In order to remove moisture, before sealing a display panel, moisture absorbents of various forms may be included, so that the display panel is complete.

However, after forming the moisture absorbent in a sealing substrate, because the sealing substrate should be cohered, there may be a problem that a production process is complicated and the number of components increases.

The above information disclosed in this Background section is only for enhancement of understanding of the background of the described technology and therefore it may contain information that does not form the prior art that is already known in this country to a person of ordinary skill in the art.

SUMMARY

Aspects of embodiments of the present invention provide a flexible display device that may simplify a process of forming a display panel by forming a moisture absorbent.

An exemplary embodiment provides a flexible display device including: a flexible substrate having a display area and a moisture absorption area at a surface; a display unit at the display area; a moisture absorption layer at the moisture absorption area; and a sealant along an edge of the display area and configured to seal the moisture absorption layer and the display unit. The flexible substrate is configured to be folded at least one time, and the display area and the moisture absorption area are opposite to each other.

The moisture absorption layer may be divided into a plurality of areas.

The flexible substrate may be configured to be folded between the display area and the moisture absorption area.

The moisture absorption area may include a first moisture absorption area and a second moisture absorption area, and the first moisture absorption area and the second moisture absorption area may be at either side of the flexible substrate with the display area interposed therebetween.

The flexible substrate may be configured to be folded between the first moisture absorption area and the display area and between the second moisture absorption area and the display area.

When the flexible substrate is folded, the first moisture absorption area and the second moisture absorption area may be overlapped with the flexible substrate interposed therebetween.

The moisture absorption area may include a first moisture absorption area and a second moisture absorption area, and the first moisture absorption area and the second moisture absorption area may be adjacent one another with a constant gap therebetween.

The flexible substrate may be configured to be folded between the first moisture absorption area and the second moisture absorption area and between the first moisture absorption area and the display area.

The flexible display device may further include a sealant along an edge of the second moisture absorption area.

The sealant may extend along a boundary line of the display area or the moisture absorption area, except for a folded portion.

The flexible substrate may include at least one of polyimide, polycarbonate, polyacrylate, polyetherimide, polyethersulfone, polyethylene terephthalate, and polyethylene naphthalate.

When manufacturing a flexible display device according to a method of embodiments of the present invention, a process of forming a moisture absorption layer may be simplified.

Further, by forming a moisture absorption layer in a plurality of layers, a moisture absorption ability of a flexible (or flexibility) display device may be improved.

DETAILED DESCRIPTION

Figure 1:
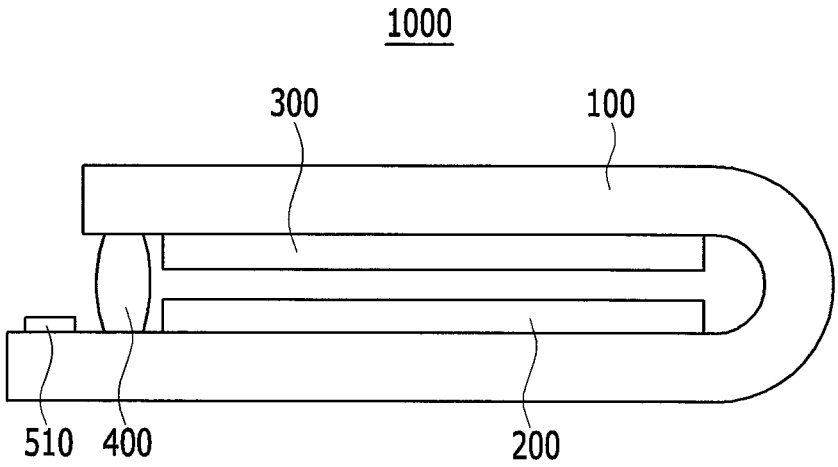
FIG. 1 is a cross-sectional view illustrating a flexible display device according to an exemplary embodiment.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., may be exaggerated for clarity. Like reference numerals designate like elements throughout the specification. It will be understood that when an element such as a layer, film, region, or substrate is referred to as being "on" another element, it may be directly on the other element or intervening elements may also be present. In contrast, when an element is referred to as being "directly on" another element, there are no intervening elements present.

Hereinafter, a flexible display device according to an exemplary embodiment will be described in detail with reference to the drawings.

Figure 2:
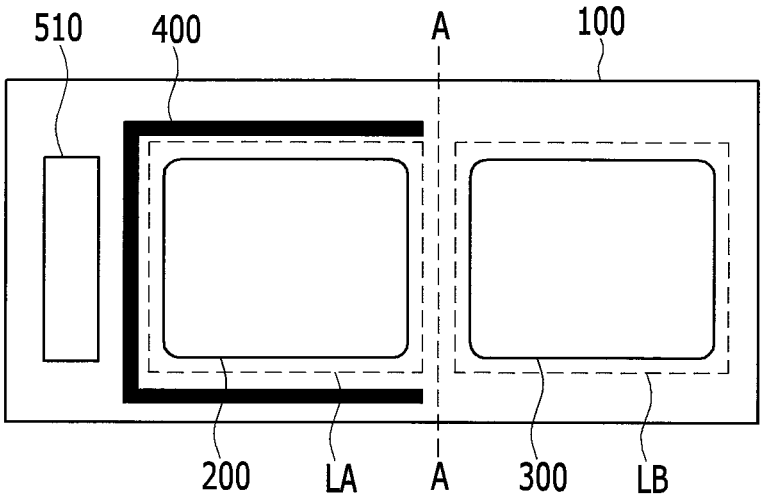
FIG. 2 is a top plan view illustrating the flexible display device of FIG. 1.
Figure 3:
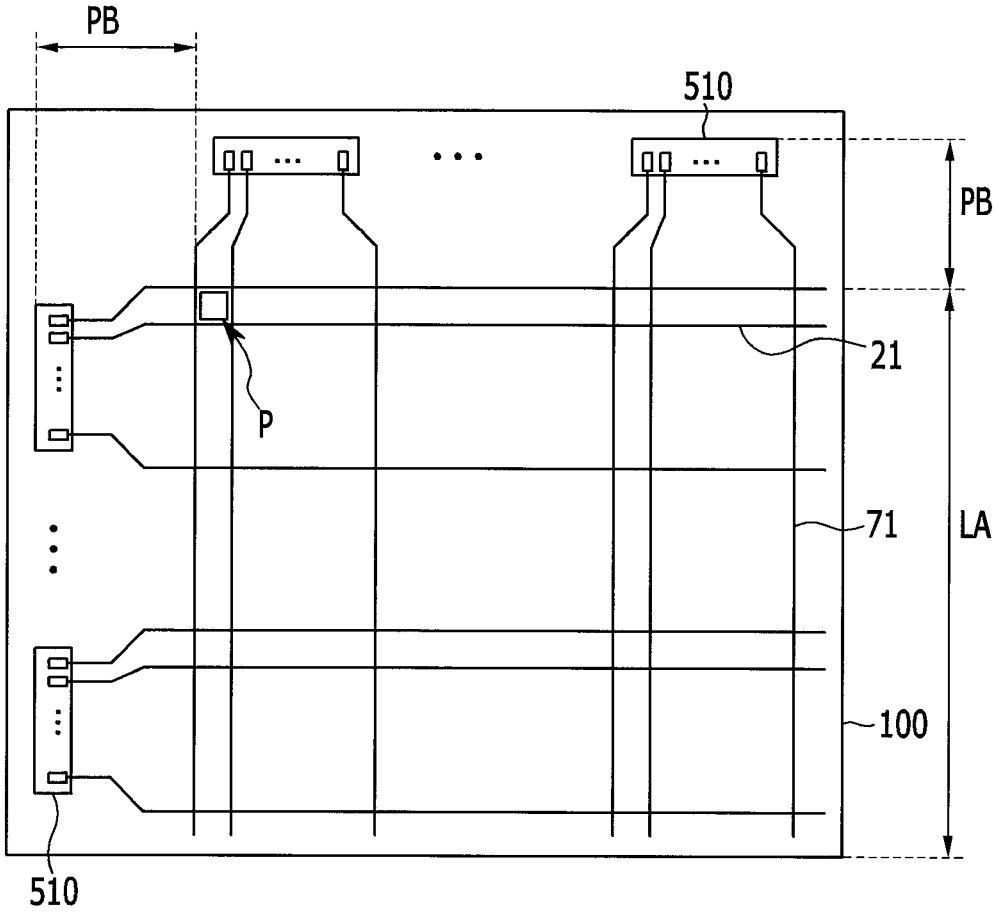
FIG. 3 is a layout view illustrating a display unit of a flexible display device according to an exemplary embodiment.
Figure 4:
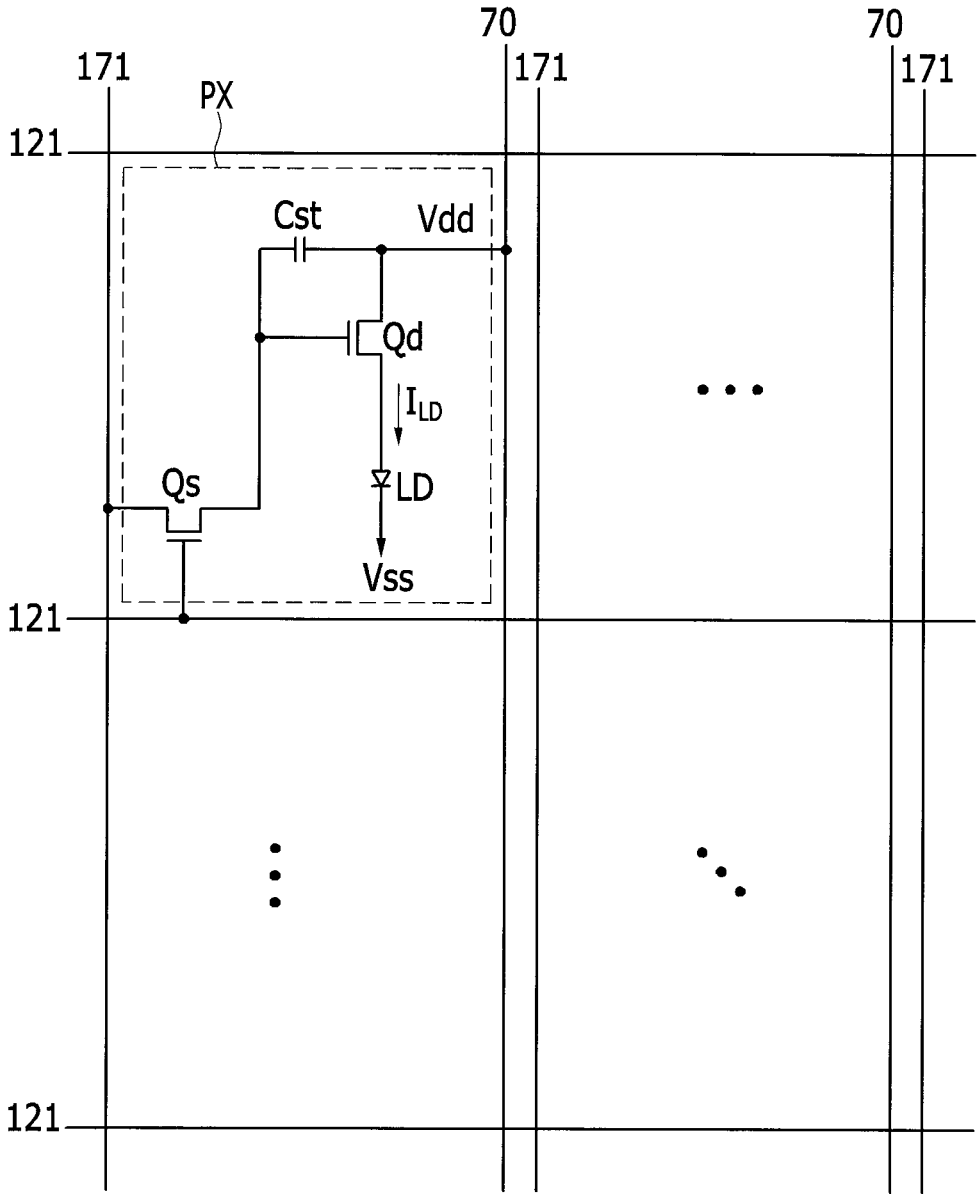
FIG. 4 is an equivalent circuit diagram of one pixel of a display unit according to an exemplary embodiment.
Figure 5A:
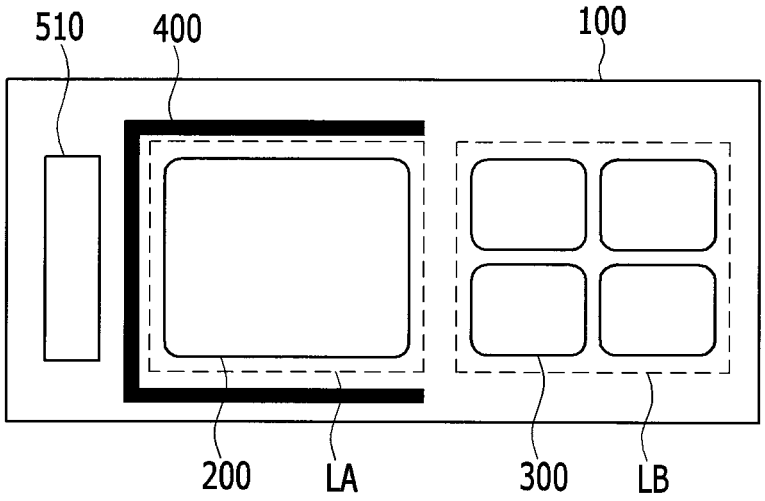
FIGS. 5A to 5C are top plan views illustrating a flexible display device according to another exemplary embodiment.
Figure 5B:
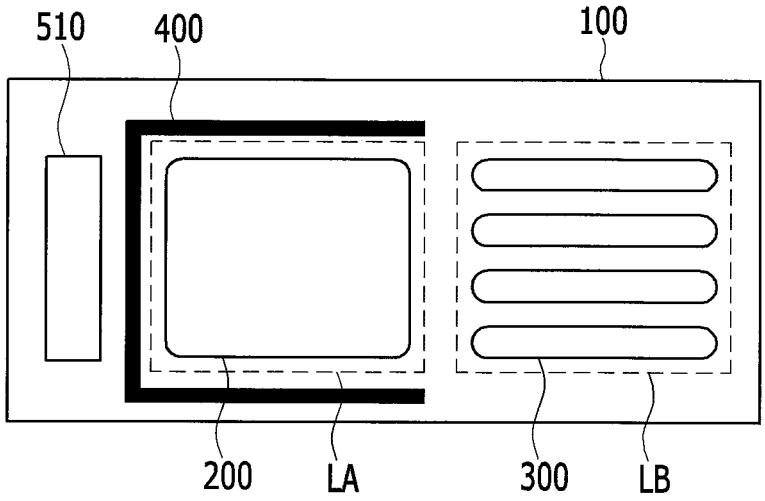
Figure 5C:
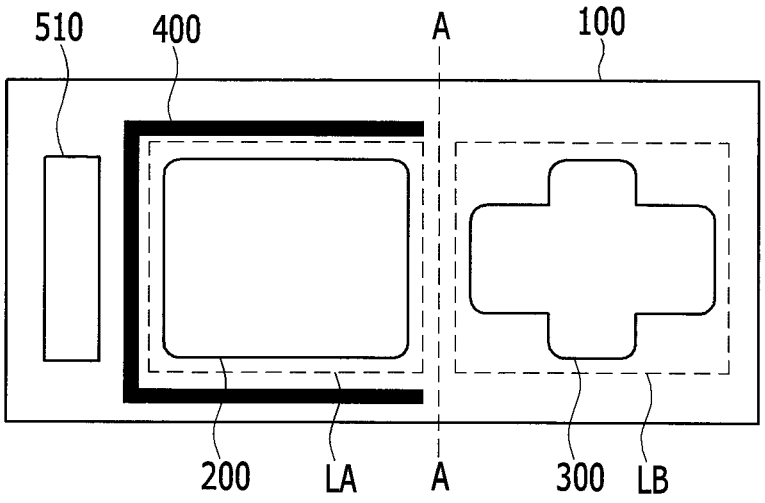

FIG. 1 is a cross-sectional view illustrating a flexible display device according to an exemplary embodiment, FIG. 2 is a top plan view illustrating the flexible display device of FIG. 1, FIG. 3 is a layout view illustrating a display unit of a flexible display device according to an exemplary embodiment, FIG. 4 is an equivalent circuit diagram of one pixel of a display unit according to an exemplary embodiment, and FIGS. 5A to 5C are top plan views illustrating a flexible display device according to another exemplary embodiment.

As shown in FIGS. 1 and 2, a flexible (or flexibility) display device 1000 according to an exemplary embodiment includes a substrate 100, a display unit 200 including an OLED that is positioned on the substrate 100, and a moisture absorption layer 300 that is positioned on the substrate 100 and that faces the display unit 200.

The substrate 100 may be a flexible substrate and may use at least one of polyimide, polycarbonate, polyacrylate, polyetherimide, polyethersulfone, polyethylene terephthalate, and polyethylene naphthalate. Because polyimide may tolerate (or may be available in) a high process temperature of 450° C. or more, when manufacturing a thin film transistor, deterioration of a characteristic of the thin film transistor may be reduced (or minimized).

Referring to FIG. 2, the substrate 100 may include a display area LA and a moisture absorption area LB that are positioned on the same surface, and the substrate 100 may be folded and thus the display area LA and the moisture absorption area LB are opposite to each other.

According to an embodiment, in the display area LA, the display unit 200 that is formed with a pixel including the OLED is formed, and in the moisture absorption area LB, the moisture absorption layer 300 is formed.

The moisture absorption layer 300 may include at least one of metal oxide, organic metal complex, metal sulfate, metal halide, metal perchlorate, phosphorus pentoxide ($P_2O_5$), molecule sieve, and silica gel. For example, the moisture absorption layer 300 may be formed in a single layer or a plurality of layers of barium oxide (BaO), calcium oxide (CaO), strontium oxide (SrO), alkyl aluminum alkoxide (RAlOR'), phosphorus pentoxide ($P_2O_5$), magnesium oxide (MgO), barium (Ba), calcium (Ca), and optical functional polymer.

The moisture absorption layer 300 may be formed to have the same area as that of the display area LA, or as shown in FIGS. 5A to 5C, the moisture absorption layer 300 may be divided into a plurality of small areas and may be formed in various shapes and forms such as a linear shape, a cross shape, a circular shape, or a polygonal shape.

Referring to FIG. 3, in one embodiment, on a display area of a flexible substrate 100, a first signal line 21 that is formed in one direction and that transfers a scan signal, a second signal line 71 that intersects the first signal line 21 and that transfers a video signal, and a plurality of pixels P that are coupled (or connected) to the first signal line 21 and the second signal line 71 to display an image and that form a matrix, are formed. The pixel may further include various signal lines to which other signals are applied in addition to the first signal line and the second signal line.

Referring to FIGS. 2 and 3, the substrate 100 may further include a peripheral area PB that is positioned at the outside of the display area LA and at which a driver 510 for controlling a thin film transistor of the display area LA is positioned. The driver 510 may be formed with an IC chip and may be mounted on the substrate 100, or may be integrated on the substrate 100 together with the thin film transistor of the display area LA.

Referring to FIG. 4, an OLED display according to an exemplary embodiment includes a plurality of signal lines 121, 171, 70 and a plurality of pixels PX that are coupled (or connected) thereto and that are arranged in an approximately matrix form.

The signal lines may include a plurality of gate lines 121 that transfer a gate signal (or a scan signal), a plurality of data lines 171 that transfer a data signal, and a plurality of driving voltage lines 70 that transfer a driving voltage Vdd. In one embodiment, each of the gate lines 121 extends in an approximately row direction and are substantially parallel to each other, and a vertical direction portion of the data lines 171 and the driving voltage lines 70 extend in an approximately column direction and are substantially parallel to each other.

Each pixel PX may include a switching thin film transistor Qs, a driving thin film transistor Qd, a storage capacitor Cst, and an OLED LD.

The switching thin film transistor Qs may have a control terminal, an input terminal, and an output terminal. In one embodiment, the control terminal is connected to the gate line 121, the input terminal is connected to the data line 171, and the output terminal is connected to the driving thin film transistor Qd. The switching thin film transistor Qs transfers a data signal that is applied to the data line 171 to the driving thin film transistor Qd in response to a scan signal that is applied to the gate line 121.

The driving thin film transistor Qd may also have a control terminal, an input terminal, and an output terminal, the control terminal is connected to the switching thin film transistor Qs. In one embodiment, the input terminal is connected to the driving voltage line 70, and the output terminal is connected to the OLED LD. The driving thin film transistor Qd enables an output current $I_{LD}$ having a changing magnitude to flow according to a voltage that is applied between the control terminal and the output terminal.

The capacitor Cst may be connected between the control terminal and the input terminal of the driving thin film transistor Qd. The capacitor Cst charges a data signal that is applied to the control terminal of the driving thin film transistor Qd and may sustain this state even after the switching thin film transistor Qs is turned off.

The OLED LD may have an anode that is connected to the output terminal of the driving thin film transistor Qd and a cathode that is connected to a common voltage Vss. The OLED LD may emit light with different intensity according to the output current $I_{LD}$ of the driving thin film transistor Qd, thereby displaying an image.

Each of the switching thin film transistor Qs and the driving thin film transistor Qd may be an n-channel field effect transistor (FET). However, at least one of the switching thin film transistor Qs and the driving thin film transistor Qd may be a p-channel FET. Further, a connection relationship of the thin film transistors Qs and Qd, the capacitor Cst, and the OLED LD may be varied (or changed).

Referring again to FIGS. 1 and 2, a sealant 400 may be formed on the substrate 100, and by coupling the display area LA and the moisture absorption area LB of the folded substrate 100, the display area LA and the moisture absorption area LB may be sealed by the sealant 400.

The sealant 400 may be formed at an edge of the substrate 100 to enclose the display area LA or the moisture absorption area LB along a boundary line of the display area LA or the moisture absorption area LB, excluding (or except for) a folded portion A of the substrate 100.

The sealant 400 may be a thermosetting adhesive or a photo-curable adhesive and may use glass frit.

Hereinafter, a method of forming a display device according to an embodiment of the present invention will be described with reference to FIGS. 6 to 8.

Figure 6:
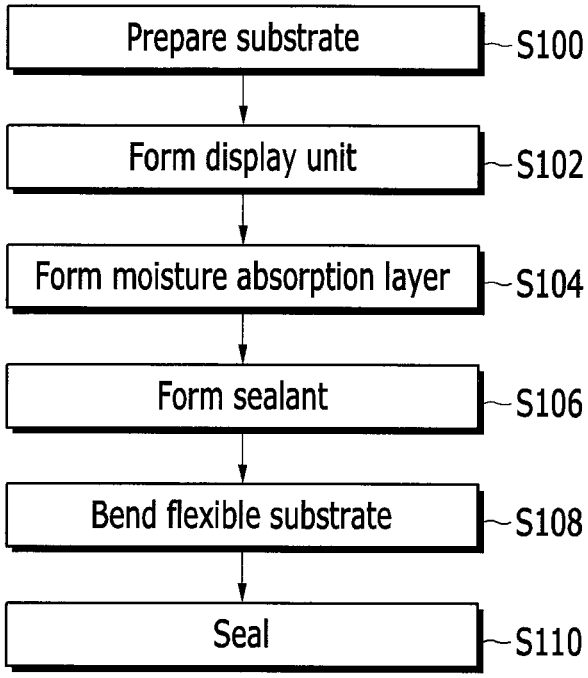
FIG. 6 is a flowchart illustrating a method of forming a display device according to an exemplary embodiment.
Figure 7:
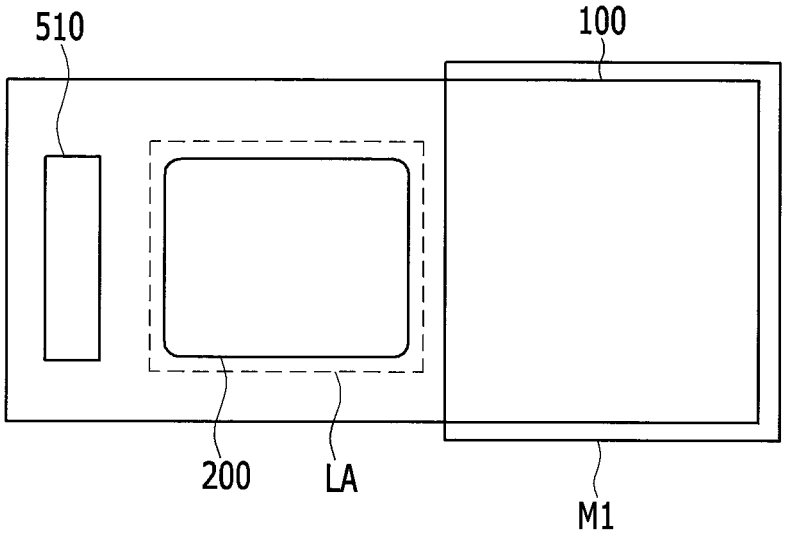
FIGS. 7 and 8 are diagrams illustrating a method of manufacturing a flexible display device according to the flowchart of FIG. 6.
Figure 8:
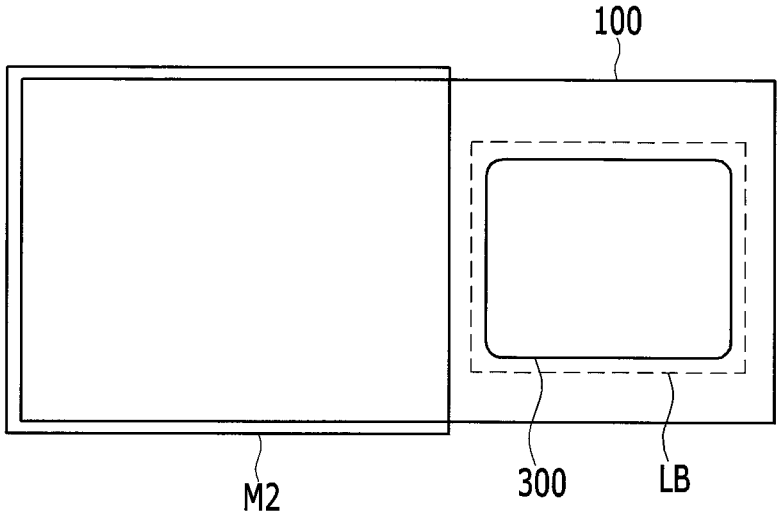

FIG. 6 is a flowchart illustrating a method of forming a display device according to an exemplary embodiment, and FIGS. 7 and 8 are diagrams illustrating a method of manufacturing a flexible display device according to the flowchart of FIG. 6.

As shown in FIG. 6, a method of manufacturing a display device according to an exemplary embodiment includes the steps of preparing a flexible substrate (S100), forming a display unit in a display area of the flexible substrate (S102), forming a moisture absorption layer in a moisture absorption area (S104), forming a sealant (S106), bending the flexible substrate after forming the display area and the moisture absorption area opposite to each other (S108), and sealing the display unit and the moisture absorption layer using a sealant (S110).

For example, as shown in FIGS. 6 and 7, a flexible substrate having a display area LA and a moisture absorption area LB is prepared (S100), and the display unit 200 is formed in the display area LA of the flexible substrate 100.

According to one embodiment, because the moisture absorption area LB is covered by a mask M1, in a deposition or etching process of forming the display unit 200, the moisture absorption area LB is not exposed.

Thereafter, as shown in FIGS. 6 and 8, the mask M1 is removed, and the moisture absorption layer 300 is formed in the moisture absorption area LB. The moisture absorption layer 300 may be formed by various methods including vacuum deposition using E-beam, printing a liquid moisture absorbent using inkjet, or applying using a dispenser.

Calcium oxide and barium oxide may be formed by vacuum deposition, and when the moisture absorption layer 300 is formed by deposition, the display area LA may be covered by a mask M2 and thus in a process of forming the moisture absorption layer 300, the display area LA is not exposed.

When a liquid process such as inkjet is used, the moisture absorption layer may be selectively applied (or used) only in the moisture absorption area, and thus a separate mask may be unnecessary.

Thereafter, as shown in FIGS. 5A to 5C and 6, the sealant 400 is formed on the substrate 100. The sealant 400 is formed along an edge of the display area LA, or is formed along an edge of the moisture absorption area LB.

Thereafter, as shown in FIGS. 1 and 6, after the display area LA and the moisture absorption area LB are formed opposite to each other by bending the flexible substrate 100, by curing the sealant 400, the display unit 200 and the moisture absorption layer 300 are sealed.

Figure 9:
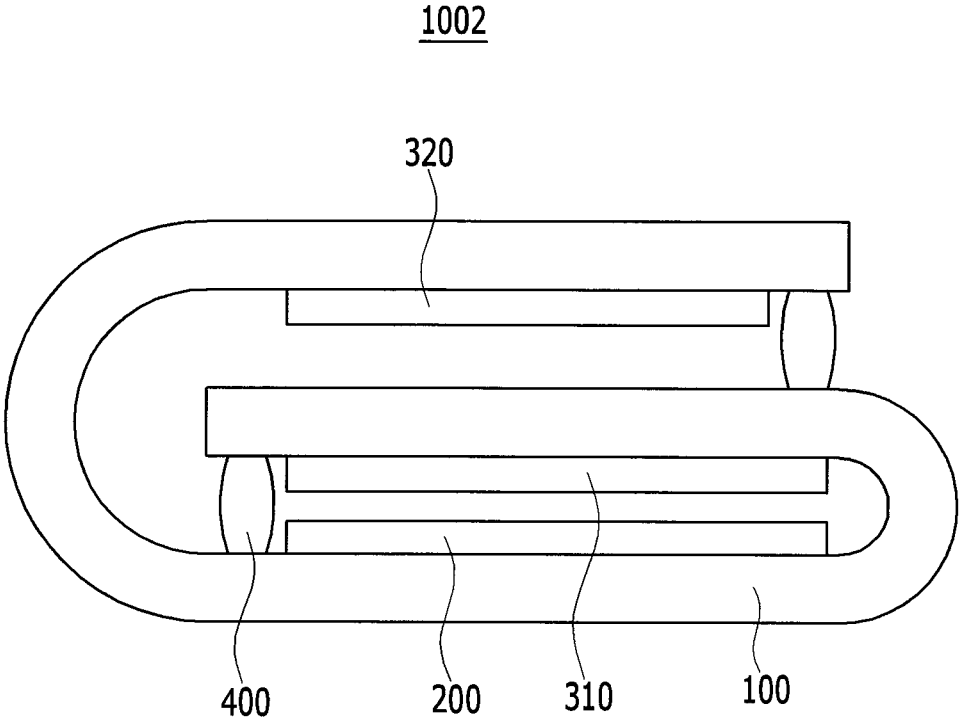
FIGS. 9 and 11 are cross-sectional views illustrating a flexible display device according to another exemplary embodiment.
Figure 10:
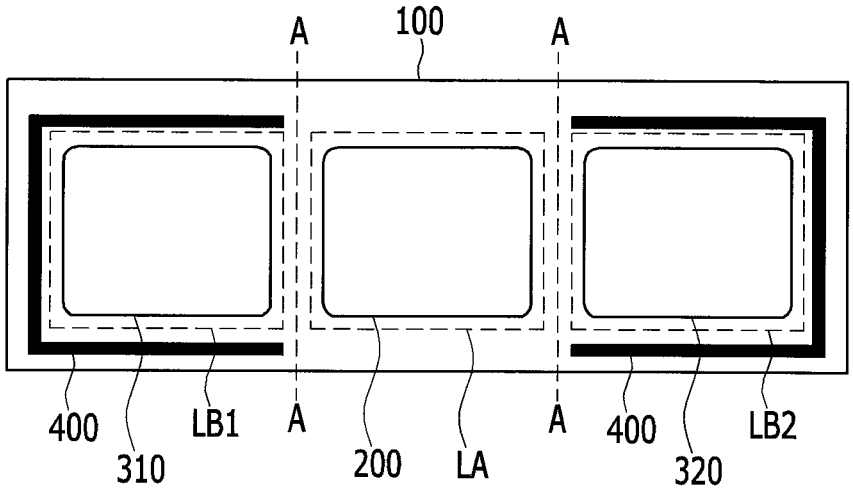
FIGS. 10 and 12 are top plan views illustrating the flexible display device of FIGS. 9 and 11, respectively.
Figure 11:
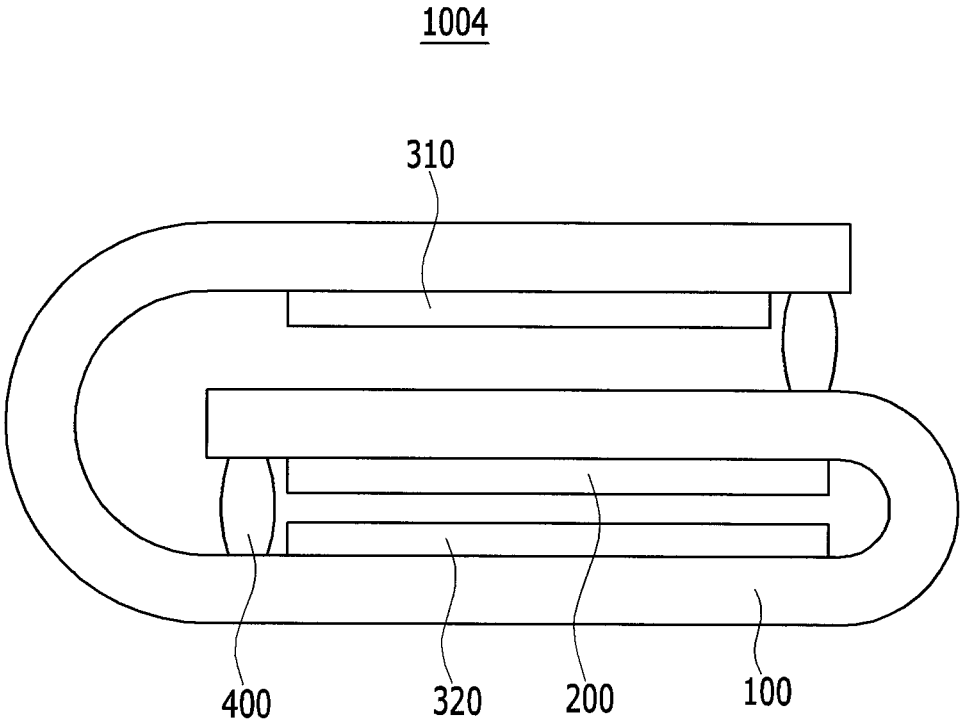

The foregoing exemplary embodiment illustrates a flexible display device that is folded one time, but as shown in FIGS. 9 to 11, the flexible display device may be folded two times or may be folded three or more times, as needed. However, when the flexible display device is repeatedly folded three or more times, a thickness of the flexible display device may increase and thus it may be preferable that the flexible display device is folded three or less times.

Figure 12:
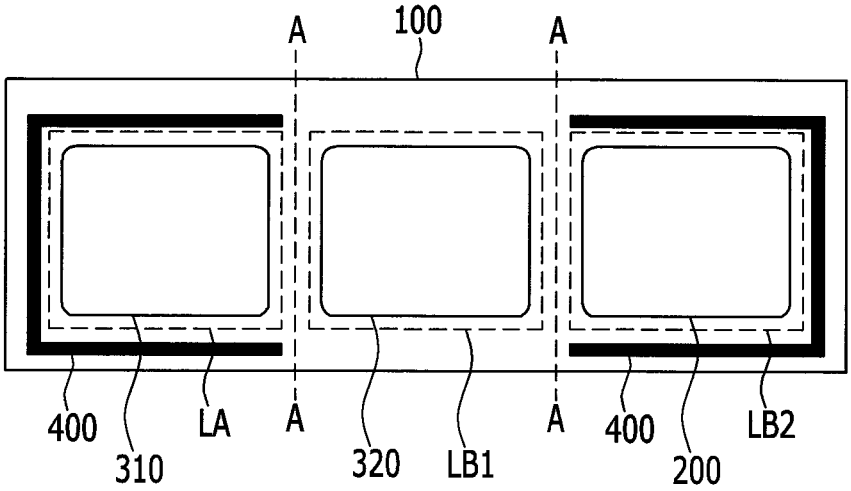

FIGS. 9 and 11 are cross-sectional views illustrating a flexible display device according to another exemplary embodiment, and FIGS. 10 and 12 are top plan views illustrating the flexible display device of FIGS. 9 and 11, respectively.

A flexible display device 1002 of FIGS. 9 and 10 includes a substrate 100, a display unit 200 including an OLED that is positioned on the substrate 100, and a first moisture absorbent 310 and a second moisture absorbent 320 that are positioned on the substrate 100 and that are positioned on the display unit 200.

In one embodiment the substrate 100 includes a display area LA, a first moisture absorption area LB1, and a second moisture absorption area LB2 that are positioned on (or at) the same surface. The display area LA, the first moisture absorption area LB1, and the second moisture absorption area LB2 may be arranged in order of the first moisture absorption area LB1, the display area LA, and the second moisture absorption area LB2. The substrate 100 may be folded between the display area LA and the first moisture absorption area LB1 and between the display area LA and the second moisture absorption area LB2, and therefore the first moisture absorption area LB1 and the second moisture absorption area LB2 may be overlapped with the flexible substrate 100 interposed therebetween, and the first moisture absorption area LB1 and the display area LA may be positioned opposite to each other.

Further, a flexible display device 1004 of FIGS. 11 and 12 includes a substrate 100, a display unit 200 including an OLED that is positioned on the substrate 100, and a first moisture absorbent 310 and a second moisture absorbent 320 that are positioned on the substrate 100 and that are positioned on the display unit 200.

In one embodiment, the substrate 100 includes a display area LA, a first moisture absorption area LB1, and a second moisture absorption area LB2 that are positioned on the same surface. The substrate 100, the display area LA, the first moisture absorption area LB1, and the second moisture absorption area LB2 may be arranged in order of the display area LA, the first moisture absorption area LB1, and the second moisture absorption area LB2. The substrate 100 may be folded between the first moisture absorption area LB1 and the second moisture absorption area LB2 and between the first moisture absorption area LB1 and the display area LA, and therefore the first moisture absorption area LB1 and the display area LA may be overlapped with the flexible substrate 100 interposed therebetween, and the second moisture absorption area LB2 and the display area LA are positioned opposite to each other.

In this way, when a flexible display device of the present exemplary embodiment is formed by folding two or more times, the flexible display device may have a thickness larger than that of the flexible display device of FIG. 1, but the moisture absorption area may be stacked in plural. Therefore, a moisture absorption ability of the flexible display device may be improved.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and equivalents thereof.

What is claimed is:

1. A flexible display device, comprising:

a flexible substrate having a display area and a moisture absorption area at a surface;

a display unit at the display area;

a moisture absorption layer at the moisture absorption area; and a sealant along an edge of the display area and configured to seal the moisture absorption layer and the display unit, wherein the flexible substrate is configured to be folded at least one time, and the display area and the moisture absorption area are opposite to each other.

2. The flexible display device of claim 1, wherein the moisture absorption layer is divided into a plurality of areas.

3. The flexible display device of claim 1, wherein the flexible substrate is configured to be folded between the display area and the moisture absorption area.

4. The flexible display device of claim 1, wherein the moisture absorption area comprises a first moisture absorption area and a second moisture absorption area, and the first moisture absorption area and the second moisture absorption area are at either side of the flexible substrate with the display area interposed therebetween.

5. The flexible display device of claim 4, wherein the flexible substrate is configured to be folded between the first moisture absorption area and the display area and between the second moisture absorption area and the display area.

6. The flexible display device of claim 5, wherein when the flexible substrate is folded, the first moisture absorption area and the second moisture absorption area are overlapped with the flexible substrate interposed therebetween.

7. The flexible display device of claim 1, wherein the moisture absorption area comprises a first moisture absorption area and a second moisture absorption area, and the first moisture absorption area and the second moisture absorption area are adjacent one another with a constant gap therebetween.

8. The flexible display device of claim 7, wherein the flexible substrate is configured to be folded between the first moisture absorption area and the second moisture absorption area and between the first moisture absorption area and the display area.

9. The flexible display device of claim 8, further comprising a sealant along an edge of the second moisture absorption area.

10. The flexible display device of claim 1, wherein the sealant extends along a boundary line of the display area or the moisture absorption area, except for a folded portion.

11. The flexible display device of claim 1, wherein the flexible substrate comprises at least one of polyimide, polycarbonate, polyacrylate, polyetherimide, polyethersulfone, polyethylene terephthalate, and polyethylene naphthalate.

* * * * *